US006874403B2

(12) United States Patent
Strayn

(10) Patent No.: US 6,874,403 B2
(45) Date of Patent: Apr. 5, 2005

(54) ASSEMBLY AND A METHOD FOR INCREASING THE ACCURACY OF A PROJECTILE

(76) Inventor: John Strayn, 34625 Blackfoot St., Westland, MI (US) 48185

( * ) Notice: Subject to any disclaimer, the term of this patent is extended or adjusted under 35 U.S.C. 154(b) by 0 days.

(21) Appl. No.: 10/287,993

(22) Filed: Nov. 5, 2002

(65) Prior Publication Data

US 2004/0083639 A1 May 6, 2004

(51) Int. Cl.[7] ..... F41B 11/00

(52) U.S. Cl. ..... 89/160; 42/106; 42/76.01; 42/77; 124/72; 124/74; 124/58

(58) Field of Search ..... 124/72, 74, 58; 42/76.01, 77, 106; 89/29, 160

(56) References Cited

U.S. PATENT DOCUMENTS 4,373,422 A * 2/1983 Washburn et al. ..... 89/33.25
4,570,607 A * 2/1986 Stokes ..... 124/56
4,841,835 A * 6/1989 Bohler et al. ..... 89/12
4,858,514 A * 8/1989 Argon ..... 89/37.05
5,283,970 A * 2/1994 Aigner ..... 42/57
5,408,915 A * 4/1995 Stoner ..... 89/33.14
5,668,343 A * 9/1997 Simon et al. ..... 89/12
5,707,063 A * 1/1998 Tzeng et al. ..... 273/440
5,829,635 A * 11/1998 Brovelli ..... 222/39
5,931,061 A * 8/1999 Kuo ..... 81/57.29
5,974,941 A * 11/1999 Kushnir et al. ..... 89/155
6,152,125 A * 11/2000 Piper ..... 124/59

FOREIGN PATENT DOCUMENTS

GB 2104198 A * 3/1983 ..... F41F/01/00

* cited by examiner

*Primary Examiner*—J. Woodrow Eldred
(74) *Attorney, Agent, or Firm*—Law Offices of John Chupa & Ass, P.C.

(57) ABSTRACT

An assembly (10) having an outer barrel (12) and an inner barrel (30) having a pair of dissimilar sized bearings (38, 40) which are press fit within the outer barrel (12) and which permit the inner barrel (30) to mechanically rotate by the use of a motor assembly (50), a gear assembly (52), a battery (92), a gear (36), and a switch (54) having a depressible plunger (56) and a method for increasing the accuracy of a paint projectile by use of the assembly 10.

14 Claims, 2 Drawing Sheets

ASSEMBLY AND A METHOD FOR INCREASING THE ACCURACY OF A PROJECTILE

FIELD OF THE INVENTION

The present invention generally relates to an assembly and a method for increasing the accuracy of a projectile and, more particularly, a rotating barrel assembly which imparts spin upon a projectile traversing through the barrel assembly in an efficient manner.

BACKGROUND OF THE INVENTION

It is well known to one who is skilled in the relevant art that the rotation of a bullet by means of a rifled barrel dramatically increases the accuracy of a bullet (i.e., rifling improves accuracy by frictionally engaging the bullet and forcibly causing the bullet to be spun or rotated). It is also well known to one who is a skilled artisan that paint ball rounds or bullets can not be fired through a rifled barrel. That is, the raised rifling within a rifled barrel produces or imparts such a substantial amount of friction on a paint ball or bullet, that the generally fragile outer shell of the paint ball or bullet is ruptured prior to exiting the barrel, thereby resulting in a clogged barrel and a paint ball barrel which does not propel a paint ball in a desired manner.

One previous method for attempting to improve the accuracy of a paint ball or bullet is lengthening the barrel of the gun through which the paint ball or bullet must traverse. Although this previous method does increase the accuracy of a paint projectile, it does suffer from some drawbacks.

For example and without limitation, a lengthened barrel causes a substantially larger amount of friction to be imparted upon the paint ball or bullet, which undesirably requires a greater amount of pressurized gas to overcome the friction (i.e., paint ball or paint marker guns are conventionally fired using both a mechanical and a pressurized gas shot concomitantly). This methodology, in turn, drains the pressurized gas container substantially faster than a shorter or conventional barrel, thereby increasing the cost of utilizing the paint marker or paint ball-gun while concomitantly shortening the duration of time a user of the "extended barrel gun" can play or work before the user is required to change pressurized gas containers or refill the pressurized container.

Another drawback of this prior methodology is that, although the longer barrel does increase the accuracy of the paint projectile, it does not increase the accuracy substantially. That is, the longer barrel does provide a longer conduit for a paint projectile to traverse, thereby allowing for a more stable shot (i.e., as compared to a shorter barrel), but once the paint ball or bullet has traversed the barrel, wind shear and the natural movement of the projectile (i.e., the natural movement of the projectile is solely dependant upon the shape of the projectile) act upon the projectile and force the projectile in random directions (i.e., this phenomena is often called "curve shot"). Furthermore, this curve shot can be dramatically increased if the paint ball or bullet is fired in a manner which allows wind shear to contact the seam of the paint ball (i.e., the seam of a paint ball is a portion of the paint ball which is either is indented or protruding around the circumference of the projectile dependent upon the brand name of the projectile and the manufacturing process of the projectile). Hence, wind shear acting upon a seam of a paint ball or bullet has the same effect as wind shear acting upon a baseball being pitched. That is, the greater the speed at which the baseball is thrown, the greater the effect of the desired baseball pitch (e.g., no spin or "knuckle ball" makes the baseball and paint ball move in a substantially sporadic manner which may move in substantially any direction, and spin to one seam or "curve ball" forces the baseball or paint ball curve to one side or another or in an upward or downward direction).

This phenomena (e.g., wind shear upon a seam) forces a user of the paint marking or paint ball gun to fire a plurality of shots in order to hit only one target (i.e., this technique is commonly referred to as "spray shot"). It should be obvious to one who is skilled in the relevant art that spray shot requires a plurality of paint balls or bullets to be fired which dramatically increases the amount of projectiles needed to play or work with which dramatically increases the cost of playing or working with a paint ball or paint marking gun. Moreover, the aforementioned methodology further decreases the duration of time that a player or user of the gun may play or work before reloading or changing "paint hoppers" (i.e., a paint hopper is a container which is refillable and which operatively feeds paint balls into a gun by use of gravity or mechanical means).

There is therefore a need for a method which allows a paint ball or bullet to be accurately projected from a paint ball or paint marking gun in an efficient manner. There is also a need for a method which forcibly spins a paint ball or bullet in order to provide "pseudo-rifling" to the paint ball or bullet, and which overcomes some or all of the previously delineated drawbacks of prior paint ball or bullet accuracy enhancing methods.

SUMMARY OF THE INVENTION

A first non-limiting advantage of the present invention is that it provides an assembly which increases the accuracy of a projectile in a manner which overcomes the previously delineated drawbacks of prior accuracy increasing methodologies.

A second non-limiting advantage of the invention is that it provides an assembly which increases the accuracy of a projectile in a manner which overcomes the previously delineated drawbacks of prior accuracy increasing methodologies and, more particularly, provides an assembly which rotates a barrel of a paint ball gun just prior to forcibly ejecting a paint projectile through the rotating barrel.

A third non-limiting advantage of the present invention is that it provides a method for increasing the accuracy of a paint projectile in a manner which overcomes the drawbacks of prior accuracy increasing methodologies.

A fourth non-limiting advantage of the present invention is that it provides an assembly for rotating a projectile for use in combination with a paint ball gun. Particularly the assembly comprises: a first hollow barrel comprising a first end having a first aperture and a second end having a second aperture; a second hollow barrel comprising a first end, a second end, and a middle portion, wherein the first end includes a third aperture, the second end includes a fourth aperture, and wherein the middle portion includes a first gear, wherein the second barrel is rotatably inserted within the first barrel; a motor assembly having an output shaft; a source of electrical energy which is coupled to the motor assembly and which selectively sources electrical energy to the motor assembly, effective to produce torque; a gear assembly having a second gear, wherein the output shaft transfers the produced torque from the motor assembly to the first gear of the gear assembly, and wherein the second gear transfers torque to the first gear, effective to rotate the second barrel.

A fifth non-limiting advantage of the present invention is that it provides a rotating barrel assembly for use with a projectile and a conventional paint ball gun having a trigger portion and a handle portion. Particularly, the assembly comprises: an outer hollow barrel comprising a first end having a first aperture and a second end having a second aperture, the first aperture and the second apertures further having a certain diameter, wherein the diameter of the first aperture is smaller than the diameter of the second aperture; an inner hollow barrel comprising a first end, a second end, and a middle portion, wherein the first end includes a third aperture, the second end includes a fourth aperture, and wherein the middle portion includes a first gear, the third and the fourth apertures having a certain diameter, wherein the certain diameter of the third aperture is substantially smaller than the certain diameter of the fourth aperture, and wherein the inner barrel is rotatably inserted within the outer barrel; a motor assembly having an output shaft; a battery which is coupled to the motor assembly and which selectively sources electrical energy to the motor assembly, effective to produce torque; a gear assembly having a second gear, wherein the output shaft transfers the produced torque from the motor assembly to the first gear of the gear assembly; and wherein the second gear transfers torque to the first gear, effective to rotate the second barrel.

A sixth non-limiting advantage of the present invention is that it provides a method for increasing the accuracy of a paint projectile. Particularly, the method comprises the steps of: providing an outer barrel having a first aperture and a second larger aperture; providing an outer barrel wall; providing an inner barrel having at least one bearing, a third aperture, and a fourth aperture; press fitting the at least one bearing into the outer barrel; spinning the inner barrel; and forcing a paint projectile through the spinning inner barrel, thereby increasing the accuracy of the paint projectile.

These and other features, aspects, and advantages of the present invention will become apparent from a reading of the following detailed description of the preferred embodiment of the invention and by reference to the following drawings.

DETAILED DESCRIPTION OF THE PREFERRED EMBODIMENT OF THE INVENTION

The present invention may be understood more readily by reference to the following detailed description of preferred embodiments of the invention.

Before the present methods and apparatuses are disclosed and described, it is to be understood that the terminology used herein is for the purpose of describing particular embodiments only and is not intended to be limiting. It must be noted that, as used in the specification and the appended claims, the singular forms "a", "an", and "the" include plural referents unless the context clearly dictates otherwise.

Figure 1:
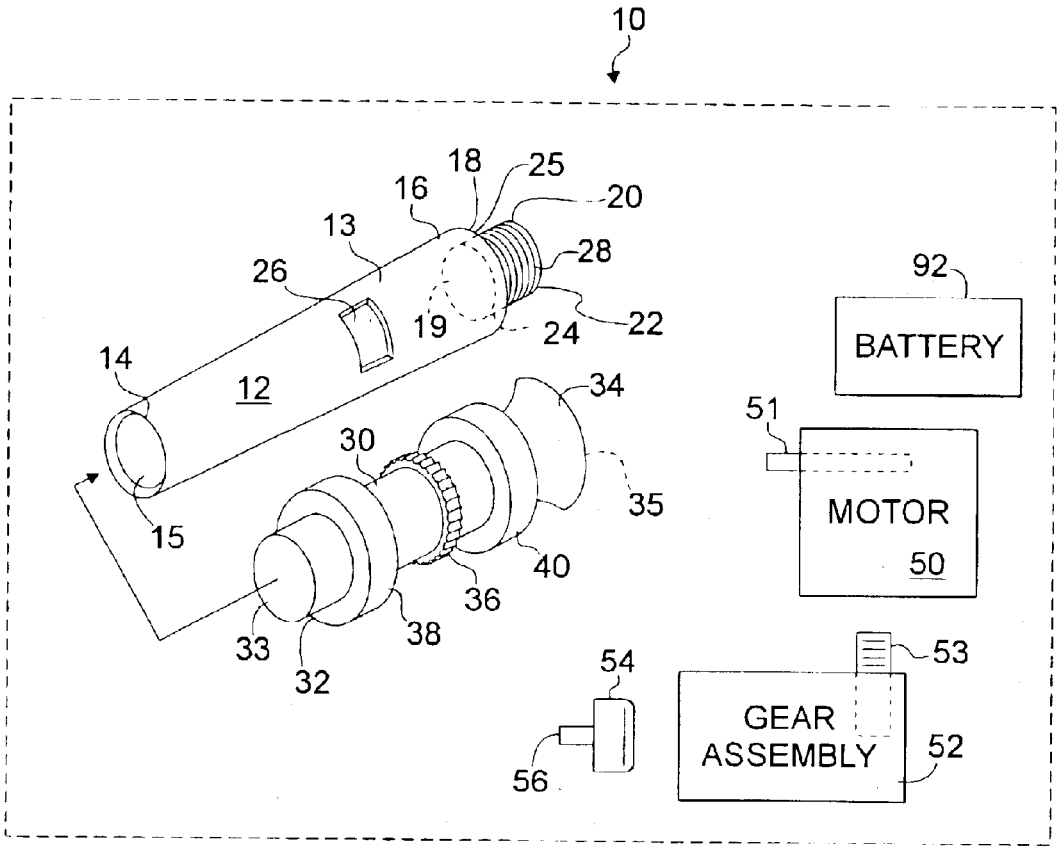
FIG. 1 is a partially disassembled view of a barrel assembly and a paint ball gun which is made in accordance with the teachings of the preferred embodiment of the invention.
Figure 1:
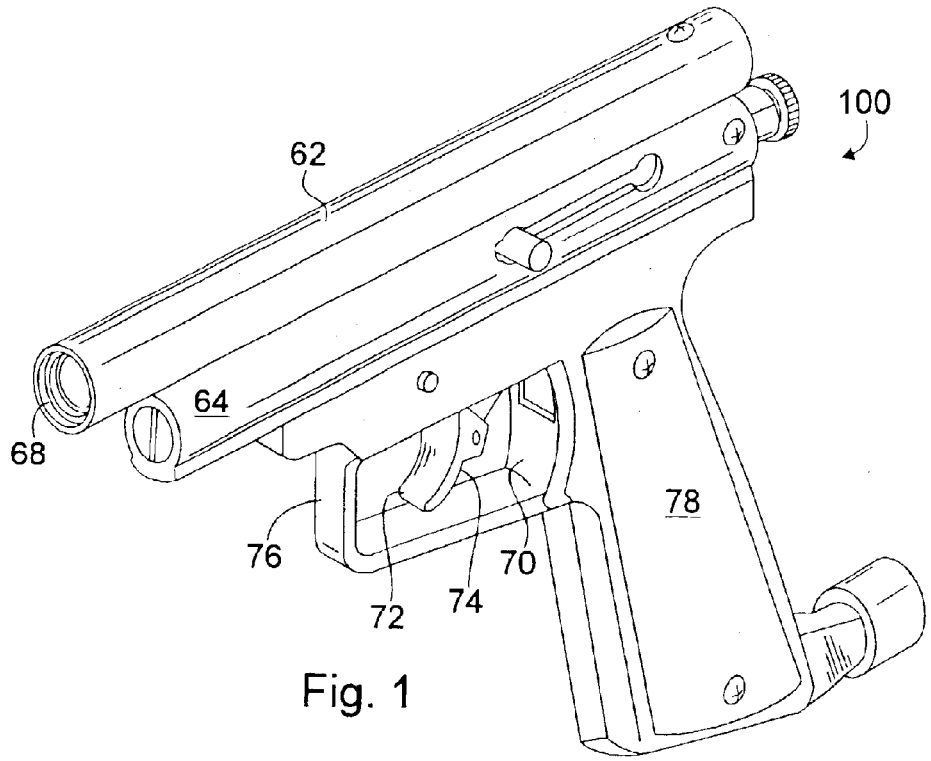

Referring now to FIG. 1, there is shown a partially disassembled view of a barrel assembly 10 which is made in accordance with the teachings of the preferred embodiment of the invention. As shown, barrel assembly 10 includes an outer barrel 12, an inner barrel 30, an electric motor 50, a gear assembly 52, a switch 54, and a paint marker or gun 100. At the outset, it should be understood that the outer barrel 12, inner barrel 30, motor 50, gear assembly 52, switch 54, and gun 100 are not drawn to scale and that the applications of the present invention are equally as applicable to substantially any desired length of barrels 14, 30. It should be further understood that only the relevant portions of the assembly 10 are illustrated and described. For example, gear assembly 52 is only shown to have a gear 53 and motor 50 is only shown to have an output shaft 51 (i.e., the gear assembly 52 and the motor 50 are conventional and well known in the art).

The outer barrel 12 generally comprises a hollow tube which includes a first open end 14 having an aperture 15 and a second end 16 having a wall 18 fixedly coupled therein (e.g., wall 18 may be welded to the second end 16). Further, an aperture 19 is formed in substantially the center of the wall 18, thereby communicatively coupling the ends 14, 16. A threaded barrel extension tube 20 is disposed through aperture 19 and is fixedly coupled to wall 18 (e.g., welded), such that tube 20 is concentrically aligned with aperture 15 of end 14 (e.g., to ensure a concentric alignment, tube 20 may be laser guided). Tube 20 comprises a first end 22 and a second end 24. Particularly, the second end 24 of the tube 20 extends into the cavity 13 of outer barrel 12 and the threading 28 of the first end 22 cooperates with the threading 68 of the barrel 62 of gun 100 (i.e., the threading 28 is received by the threading 68), thereby extending the barrel 62 of gun 100. Outer barrel 12 further includes an access aperture 26 which allows access into the cavity 13 of barrel 12.

The second inner barrel 30 generally comprises a hollow tube which has an inner diameter which gradually tapers from a first narrow open end 32 having an aperture 33 to a second wider and outwardly flaring end 34 having an aperture 35. It should be understood that the aperture 35 of the second end 34 is larger than the aperture 33 of end 32 due to the outward flaring of end 34. As shown in FIG. 1, the inner barrel 30 further includes a first bearing 38 and a second bearing 40 which are disposed around and fixedly coupled to the inner barrel 30 in close proximity to each of the ends 32 and 35 respectively (i.e., bearing 38 is disposed around end 32 and bearing 40 is disposed around end 34). It should be understood that bearing 38 has a slightly smaller exterior diameter than the exterior diameter of the second bearing 40. Inner barrel, 30 further includes a gear 36 which is disposed around the barrel 30 and fixedly coupled to barrel 30 in a position which aligns with the access aperture 26 of outer barrel 12.

Figure 2:
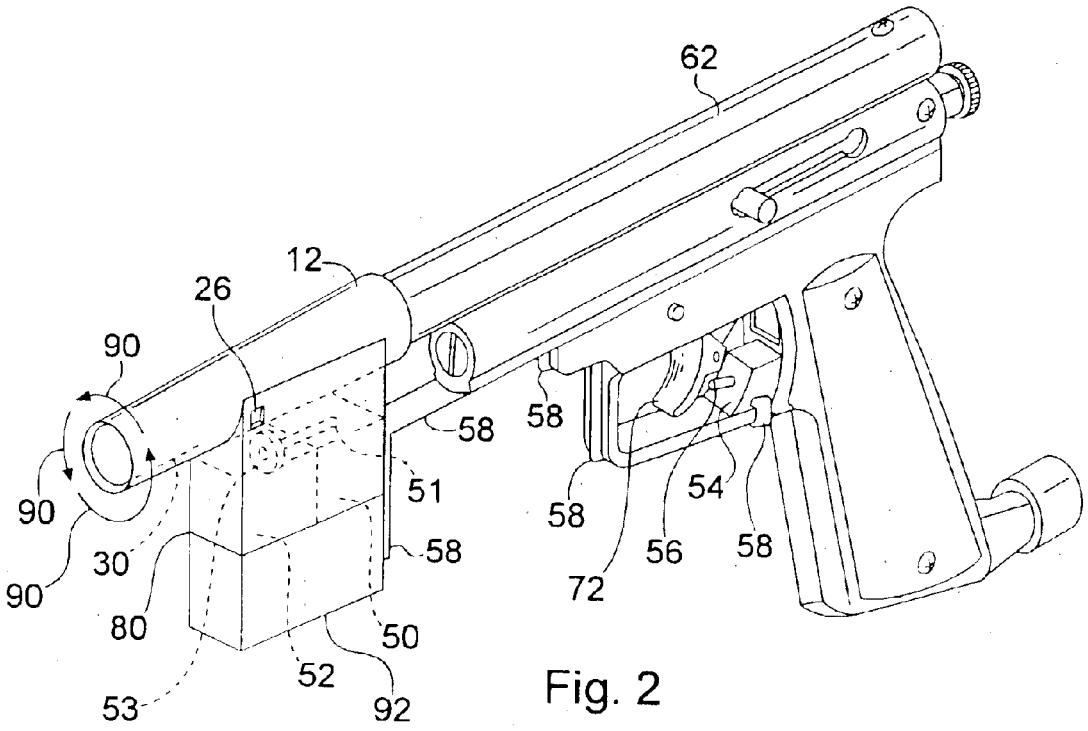
FIG. 2 is an assembled view of the assembly and the paint ball gun which are shown in FIG. 1.
Figure 3:
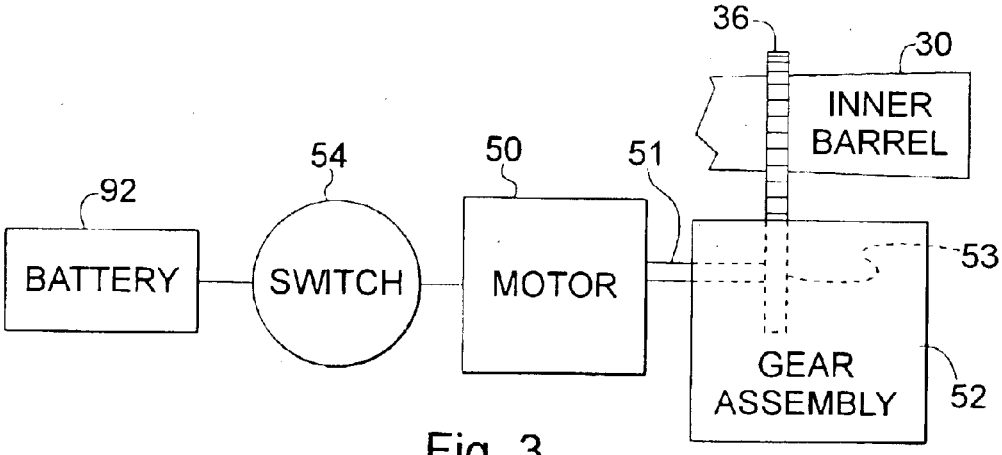
FIG. 3 is a diagram of the electro-mechanical portions of assembly shown in FIGS. 1 and 2.

Motor 50, as briefly discussed above, is a conventional direct current or "DC" motor. That is, motor 50 may be powered by a conventional battery 92. As shown in FIGS. 1, 2, and 3, motor 50 includes an output shaft 51 which, as should be apparent to one who is skilled in the relevant art, transfers torque created by the motor 50 to another object (e.g., gear assembly 52), in order to selectively propel or perform some other desired action upon the other object (e.g., rotate or spin the inner barrel 30).

Gear assembly 52, also as briefly discussed above, is a conventional gear assembly. That is, gear assembly may be provided torque by substantially any desired or conventional motor (e.g., DC motor 50). As shown in FIGS. 1, 2, and 3, gear assembly 52 includes a gear 53 which transfers torque created by the motor 50 and provided by output shaft 51 in order to selectively propel or perform some other desired action upon an object (e.g., rotate or spin the inner barrel 30). In other non-limiting embodiments of the invention, gear assembly 50 may be replaced by substantially any known, conventional, or commercially available torque transfer assembly (e.g., belt and pulley or "belt driven", chain and crank or "chain driven", or the like). In yet other non-limiting embodiments, the gear assembly 52 may be removed and the motor 50 may transfer torque directly to the inner barrel 30 (i.e., the motor 50 may utilize the inner barrel 30 directly as an output shaft).

Switch 54 is a conventional pressure switch. That is, as a certain pressure or force is applied to the plunger 56 of switch 54, electrical energy is sourced from battery 92, through switch 54, and is directed from switch 54 to another desired location (e.g., motor 50).

Gun 100, as best shown in FIG. 1, is a conventional paint marking gun having a handle 78, a trigger guard 76, a trigger 72, a longitudinally extending propelling chamber 62, and a longitudinally extending recuperator chamber 64. More particularly, handle 78 includes a recessed portion 70 which is shaped to substantially receive the back side 74 of trigger 72. It should be appreciated that nothing in this description is meant to limit the geometrical configuration of the trigger 72, the trigger guard 76, the recessed portion 70, or the style of the paint marking gun 100 to any particular geometrical configuration or style. Rather, the applications of the present invention are equally applicable to substantially any desired paint marking gun having substantially any desired geometrical configuration.

The above-delineated components (e.g., 12, 20, 30, 36, 38, 40, 50, 52, 54, and the like) are assembled in the following manner. Outer barrel 12 is provided without the wall 18 coupled to the barrel 12. Inner barrel 30 is disposed within the outer barrel 12, such that end 32 of inner barrel 30 is placed through end 16 of outer barrel 30 and forced within the cavity 13 until bearing 38 functionally engages the interior surface of barrel 12 near the end 14 of barrel 12 (i.e., the bearings 38 and 40 are press fit into the cavity 13, such that inner barrel 30 is "locked" in place and cannot fall out of outer barrel 12). It should be understood that inner barrel 30 is inserted and press fit within outer barrel 12 in a manner (e.g., laser guided) which concentrically aligns apertures 15, 33, and 34. It should be further understood that once the bearings 38, 40 of inner barrel 30 are press fit within outer barrel 12, the inner barrel 30 may now be "spun" or rotated freely by the use of bearings 38 and 40.

As mentioned above, gear 36 of inner barrel 30 is aligned with the access aperture 26 of outer barrel 12. It should be appreciated that the gear 36 and the access aperture 26 align only after the bearings 38, 40 of the inner barrel 30 are press fit within the outer barrel 12, thereby allowing access to a portion of the gear 26 (i.e., access aperture 26 allows access to approximately one-quarter to about one-third of gear 36).

Upon press fitting the bearings 38, 40 of the inner barrel 30 within the outer barrel 12, the wall 18 and the tube 20 are fixedly coupled to the outer barrel, such that the aperture 19 of wall 18 and the interior lip 24 of tube 20 are concentrically aligned with the apertures 15, 33, and 35 (e.g., by laser guiding) and such that the interior lip 24 of tube 20 is partially within the outwardly flared end 34 of inner barrel 30, thereby sealing inner barrel 30 within outer barrel 12.

As can best be viewed in FIGS. 2 and 3, the motor 50 and the gear assembly 52 are coupled together, such that the output shaft 51 of motor 50 is operatively engaged with the gear 53 of gear assembly 52. Gear assembly 52 and motor 50 are then disposed within a protective shell or casing 80. It should be appreciated that in other non-limiting embodiments the casing 80 may be shaped differently and may include a dampening material, such as acoustic foam (not-shown), effective to substantially reduce any vibrations or noise resulting from the electrical operation of the motor 50 or the mechanical operation of the gear assembly 52. The casing 80 may be formed of substantially any desired and durable material, such as but not limited to plastic or metal.

The casing 80 is coupled to the outer barrel 12, such that the gear 36 of inner barrel 30 frictionally engages the gear 53 of gear assembly 52. It should be appreciated that the casing 80 may either be fixedly coupled to the outer barrel 12 (e.g., by conventional adhesives, screws, pins, welding, or the like) or removably coupled to the outer barrel 12 (e.g., by a conventional slide and rail, pins, straps, or the like). In the preferred embodiment of the invention, the casing 80 is attached or coupled to the outer barrel 12 on the underside of the barrel, effective to keep the casing 80 out of a user's sight line, thereby allowing an unobstructed view. Furthermore, by operatively coupling the casing 80 to the underside of the barrel 12, the weight of the gun remains balanced (e.g., if the casing 80 were placed upon a side of the barrel 12, the weight of the gun would be "side heavy" thereby creating a "lean" or a biased and unbalanced side).

Switch 54 is coupled to the recessed portion 70 of handle 78, such that the plunger 56 is aligned directly with the middle of the back side 74 of trigger 72. It should be appreciated that, in this manner, when a user pulls the trigger 72 of the gun 100, the plunger 56 will be depressed before the trigger 72 has reached its release point (i.e., the "release point" is the trigger position which causes the gun 100 to fire a paint ball or paint shot). It therefore should be appreciated that the assembly 10 is activated before the trigger 72 reaches the release point and a paint ball or paint shot is discharged from the gun 100.

Assembly 10 further includes an electrical bus 58 which electrically connects the switch 54 to a conventional battery 92; and to the motor 50. The bus 58 may be hidden along the underside of the trigger guard 76 as well as the underside of the recuperator chamber 64, as shown in FIG. 2. It should be appreciated that the bus 58 may be selectively removable from the battery 92 by employing a conventional plug (not shown). It should be further appreciated that the battery may be selectively re-chargeable by use of a conventional electrical cord in cooperation with a conductive aperture (not shown) which is designed to selectively receive the conventional plug (not shown).

In one non-limiting embodiment of the invention, a conventional battery 92, such as and without limitation a nine volt battery, may be operatively and removably coupled to the assembly 10. That is, as shown in FIG. 2, battery 92 may be removably coupled to the underside of casing 80, effective to provide electrical energy to the assembly 10. It should be understood that the battery 92 is not limited to a nine volt battery. Rather, battery 92 may comprise substantially any desired voltage or sized battery. It should be further understood that the location of the battery 92 is not limited to the location which is depicted within FIG. 2 (i.e., below the casing 80). Rather, the battery 92 may be operatively and removably coupled to substantially any desired portion of the gun 100 or the assembly 10. For example and without limitation, battery 92 may be operatively coupled to the handle portion 78 of the gun 100, to the trigger guard 76 of the gun 100, to the recuperating chamber 64 of gun 100, or the like.

In operation and upon the assembly of gun 100 in the aforedelineated manner, a user of the barrel assembly 10 in cooperation with a paint marking or paint ball gun 100 may selectively couple the bus 58 to the battery 92 by use of the plug (not shown) of bus 58, thereby sourcing electrical energy from the battery 92 to the switch 54. The user of the gun 100 and the assembly 10 may then proceed to pull the trigger 72 of the paint marking or paint ball gun 100.

Upon pulling the trigger 72, the back side 74 of trigger 72 contacts the plunger 56 of switch 54 and depresses the plunger 56. Once the plunger 56 has been partially depressed, electrical energy from the battery 92 is sourced to the motor 50 which, in turn, provides torque to the gear assembly 52, thereby rotating or spinning inner barrel 30. That is, electrical energy is sourced to the motor 50 by bus 58 upon a partial depression of plunger 56 of switch 54. Electrical energy is then sourced through the switch 54 to the motor 50. Upon receipt of electrical energy, the motor 50 provides torque to the output shaft 51, thereby spinning output shaft 51. Output shaft 51 transfers the motor 50 created torque to the gear 53 of gear assembly 52, thereby rotating or spinning the gear 53. The gear 36 of inner barrel 30 then receives torque from the gear 53 of gear assembly 50, thereby rotating or spinning the inner barrel 30.

Upon a complete pull of the trigger 72 (i.e., a normal activation of the trigger 72 which results in the gun 100 firing a paint ball), the inner barrel 30 is rotating or spinning as a paint ball is shot or fired from the propelling chamber 62 in a conventional manner. Upon receipt of a paint ball or bullet, the inner barrel 30 provides rotational friction to the paint ball or bullet which is forcibly ejected from the propelling chamber, effective to spin the paint ball or bullet, thereby providing a pseudo-rifling effect which allows the paint ball or bullet to traverse a distance and more accurately strike a target. It should be understood that the term "pseudo-rifling" means that the paint ball or bullet is spun or rotated much like a conventional bullet is spun or rotated by rifling. It should be appreciated that a bullet which is spun is known to be substantially more accurate than a bullet which is not spun. Therefore, the applications of the present invention substantially reduce "curve-shot", thereby allowing a user of the assembly 10 to efficiently strike a target without the necessity of "spray-firing".

In one non-limiting embodiment of the invention, a paint ball or bullet may be individually loaded (e.g., by conventional bolt action loading and locking device) within the inner barrel 30 and spun prior to the gun forcibly propelling the paint ball out of the inner barrel. That is, the inner barrel 30 may be continuously operated without the trigger 72 contacting or depressing the plunger 56. In this manner, the paint ball or bullet is spun or rotated at a much higher speed, effective to very accurately propel a paint ball or bullet from the inner barrel 30.

It should be understood that this invention is not limited to the exact construction or embodiments listed and described, but that various changes may be made without departing from the spirit and scope of the invention. For example and without limitation, the applications of the present invention may be employed upon a traditional firearm, such as a pistol or machine gun. In further example and without limitation, the applications of the present invention may be removably utilized as an addition to an existing gun or be fixedly utilized in a stand-alone gun (a gun which is permanently attached to the assembly 10).

What is claimed is:

1. An assembly for rotating a projectile for use in combination with a paint ball gun, the assembly comprising:

a first hollow barrel comprising a first end having a first aperture and a second end having a second aperture;

a second hollow barrel comprising a first end, a second end, and a middle portion, wherein said first end includes a third aperture, said second end includes a fourth aperture, and wherein said middle portion includes a first gear, wherein said second barrel is rotatably inserted within said first barrel;

a motor assembly having an output shaft;

a source of electrical energy which is coupled to said motor assembly and which selectively sources electrical energy to said motor assembly, effective to produce torque;

a gear assembly having a second gear, wherein said output shaft transfers said produced torque from said motor assembly to said second gear of said gear assembly, and wherein said second gear transfers torque to said first gear, effective to rotate said second barrel, wherein said second barrel further includes a first bearing and a second and larger bearing, said first and said second bearing are press fit into said first barrel and around said second barrel.

2. The assembly of claim 1 further including a wall having an aperture which is identical in size to said third aperture of said second barrel, said wall being fixedly coupled to said first barrel and over said second aperture.

3. The assembly of claim 2 wherein said first barrel further comprises:

an extension conduit having a first end and a second and threaded end, said extension conduit being disposed through said aperture and coupled to said wall of said first barrel, such that said first end of said extension conduit protrudes into said first barrel, thereby creating an interior lip portion; and a reception aperture which is aligned with said first gear of said second barrel, thereby allowing access of said first gear through said first barrel.

4. The assembly of claim 3 wherein said second threaded end cooperates with said paint ball gun, effective to removably couple said first barrel to said paint ball gun.

5. The assembly of claim 4 wherein said motor assembly and said gear assembly are further disposed in a casing which is removably coupled to said paint ball gun below said first barrel.

6. The assembly of claim 5 wherein said second end of said first barrel is larger than said first end of said first barrel.

7. The assembly of claim 6 wherein said third aperture of said second barrel is substantially larger than said second aperture of said second barrel.

8. The assembly of claim 7 wherein said paint ball gun further includes a trigger having a back side and a handle having a recessed trigger reception portion, said assembly further comprising a switch having a depressible plunger portion, said switch being coupled to said recessed trigger reception portion, such that said back side of said trigger selectively abuts said plunger, effective to depress said plunger when said trigger is pulled, thereby sourcing electrical energy from said source of electrical energy to said motor assembly, effective to rotate said second barrel.

9. The assembly of claim 8 wherein said third aperture of said second barrel receives said lip portion of said first barrel.

10. A rotating barrel assembly for use with a projectile and a conventional paint ball gun having a trigger portion and a handle portion, said assembly comprising:

an outer hollow barrel comprising a first end having a first aperture and a second end having a second aperture, said first aperture and said second aperture each further having a certain diameter, wherein said diameter of said first aperture is smaller than said diameter of said second aperture;

an inner hollow barrel comprising a first end, a second end, and a middle portion, wherein said first end includes a third aperture, said second end includes a fourth aperture, and wherein said middle portion includes a first gear, said third and said fourth apertures having a certain diameter, wherein said certain diameter of said third aperture is substantially smaller than said certain diameter of said fourth aperture, and wherein said inner barrel is rotatably inserted within said outer barrel;

a motor assembly having an output shaft;

a battery which is coupled to said motor assembly and which selectively sources electrical energy to said motor assembly, effective to produce torque;

a gear assembly having a second gear, wherein said output shaft is coupled to said second gear and transfers said produced torque from said motor assembly to said second gear of said gear assembly, and wherein said second gear transfers torque to said first gear, effective to rotate said second barrel, wherein said inner barrel further includes a first bearing and a second and larger bearing, said first and said second bearings being press fit within said outer barrel and around said inner barrel.

11. The rotating barrel assembly of claim 10 wherein said outer barrel further comprises:

an extension conduit having a first end and a second threaded end, said extension conduit being coupled through said wall of said outer barrel, such that said first end of said extension conduit protrudes into said outer barrel, thereby creating an interior lip portion; and a reception aperture which is aligned with said first gear of said inner barrel, thereby allowing access of said first gear through said outer barrel.

12. The rotating barrel assembly of claim 11 wherein said motor assembly and said gear assembly are further disposed in a casing which is removably coupled to said paint ball gun below said outer barrel.

13. The rotating barrel assembly of claim 12 wherein said paint ball gun further includes a trigger having a back side and a handle having a recessed trigger reception portion, said assembly further comprising a switch having a depressible plunger portion, said switch being coupled to said recessed trigger reception portion, such that said back side of said trigger cooperates with said plunger, effective to depress said plunger when said trigger is pulled, thereby sourcing electrical energy from said battery to said motor assembly, effective to rotate said inner barrel.

14. The rotating barrel assembly of claim 13 wherein said third aperture of said inner barrel receives said lip portion of said outer barrel.

* * * * *